US007549182B2

(12) United States Patent
Murphy

(10) Patent No.: US 7,549,182 B2
(45) Date of Patent: Jun. 23, 2009

(54) SEATING UNIT CONVERTIBLE TO BED

(75) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 321 days.

(21) Appl. No.: 11/400,555

(22) Filed: Apr. 7, 2006

(65) Prior Publication Data

US 2007/0283491 A1 Dec. 13, 2007

(51) Int. Cl.
*A47C 17/04* (2006.01)

(52) U.S. Cl. ..... 5/13; 5/37.1; 5/42

(58) Field of Classification Search ..... 5/42, 5/13, 37.1, 38–39

See application file for complete search history.

(56) References Cited

U.S. PATENT DOCUMENTS 2,740,131 A * 4/1956 Vogel et al. ..... 5/42
2,876,461 A 3/1959 Bontempi
3,908,210 A 9/1975 Alembik
4,737,996 A 4/1988 Tiffany

OTHER PUBLICATIONS

Cover of *Highpoints* publication, Tiffany Sleeper, Market Introductions (Apr. 2000).
Cover of *The Philadelphia Inquirer*, Home and Design Section (Apr. 21, 2000).
*UDM Design News*, p. 32 (Jun. 2000).
Home & Garden, *Sun-Sentinel*, p. 3E (South Florida, Apr. 14, 2000).
Functional upholstery takes center stage, *Furniture Today*, vol. 24, No. 30d, 2 pages (Apr. 9, 2000).
Photograph 1, Version 1, sofa shown at trade show in San Francisco, folding center leg and Version 1 front leg actuator (Jan. 2000).
Photograph 2, Version 1, sofa shown at trade show in San Francisco, sofa partially opened (Jan. 2000).
Photograph 3, Version 1, sofa shown at trade show in San Francisco, sofa completely opened (Jan. 2000).
Photograph 4, Version 1, sofa shown at trade show in San Francisco, tube assembly front pivot offset and extended and folding center leg extended (Jan. 2000).

(Continued)

*Primary Examiner*—Fredrick Conley
(74) *Attorney, Agent, or Firm*—Myers Bigel Sibley & Sajovec

(57) ABSTRACT

A seating unit includes: a frame; a backrest section having a backrest cushion; body, hinge and foot sections sharing a common cushion; and a folding mechanism comprising a series of pivotally interconnected links configured and arranged to move the backrest, body, hinge and foot sections between folded and unfolded positions. In the unfolded position, the backrest, body, hinge and foot sections are generally horizontally disposed and serially aligned, with the backrest cushion and the common cushion facing upwardly. In the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other.

6 Claims, 5 Drawing Sheets

OTHER PUBLICATIONS

Photograph 5, Version 1, sofa shown at trade show in San Francisco, folding center leg extended and front wood leg with Version 1 of front leg actuator (Jan. 2000).

Photograph 6, Version 2, sofa shown at trade show in High Point, folding center leg extended and metal tube front leg with version 2 of front leg actuator (Apr. 2000).

Photograph 7, Version 2, sofa shown at trade show in High Point , metal tube front leg with Version 2 of front leg actuator and folding center leg extended (Apr. 2000).

Photograph 8, Version 2, sofa shown at trade show in High Point, metal tube front leg with Version 2 of from leg actuator and folding center leg extended (Apr. 2000).

Photograph 9, Versions 1 and 2, tube assembly front pivot (offset & extended).

Photograph 10, Versions 1 and 2, inside arm spring assist.

Photograph 11, Versions 1 and 2, inside arm spring assist.

Photograph 12, Versions 1 and 2, inside arm spring assist.

Stawett catalog 2003/2004.

Lusch catalog '03/'04.

* cited by examiner

SEATING UNIT CONVERTIBLE TO BED

FIELD OF THE INVENTION

The present invention relates generally to a sofa or other seating unit that is convertible into a bed, and relates more specifically to a seating unit that has backrest and seat sections that form portions of the bed.

BACKGROUND OF THE INVENTION

Seating units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other sofa-beds lack a complete mattress, but instead are constructed of separate sections that serve as support surfaces of the sofa and unfold to form a flat, mattress-like sleeping surface. An example of a convertible sofa of this type is illustrated in U.S. Pat. No. 4,737,996 to Tiffany (Tiffany). The Tiffany sofa-bed includes a backrest, a seat and a "subseat" that unfold to form the horizontal sleeping surface. In the folded "sofa" configuration, the backrest is generally upright, and the seat and "subseat" fold upon each other (with the subseat in an inverted position). The backrest is guided between positions by preformed slots in the arms of the sofa that receive posts that extend laterally from the backrest. The backrest is coupled to the seat and subseat via an angled link. The subseat is pivotally attached at one end to the arms and is hinged at the other end to the seat. This arrangement is described in Tiffany as being particularly economical and having relatively few moving parts.

Although the Tiffany-style sofa-bed has been popular with some consumers, it may be desirable to provide a sofa-bed that is less expensive and/or easier to manufacture, as the formation of the slots to guide the backrest can be expensive.

SUMMARY OF THE INVENTION

As a first aspect, embodiments of the present invention are directed to a seating unit comprising: a frame; a backrest section having a backrest cushion; body, hinge and foot sections sharing a common cushion; and a folding mechanism comprising a series of pivotally interconnected links configured and arranged to move the backrest, body, hinge and foot sections between folded and unfolded positions. In the unfolded position, the backrest, body, hinge and foot sections are generally horizontally disposed and serially aligned, with the backrest cushion and the common cushion facing upwardly. In the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other.

As a second aspect, embodiments of the present invention are directed to a seating unit comprising: a frame; a backrest section; body, hinge and foot sections; and a folding mechanism comprising a series of pivotally interconnected links configured and arranged to move the backrest, body, hinge and foot sections between folded and unfolded positions. In the unfolded position, the backrest, body, hinge and foot sections are generally horizontally disposed and serially aligned. In the folded position, the backrest section is generally upright with the backrest cushion facing forwardly, the body section is generally horizontally disposed, the foot section overlies the body section, and the hinge section is generally vertically disposed and extends between the body and foot sections. A support hinge comprising a flexible sheet member extends between at least one of (a) the body and hinge sections and (b) the hinge and foot sections. In this configuration, the support hinge can provide support to the sections between which it extends.

DETAILED DESCRIPTION OF EMBODIMENTS OF THE INVENTION

Figure 1:
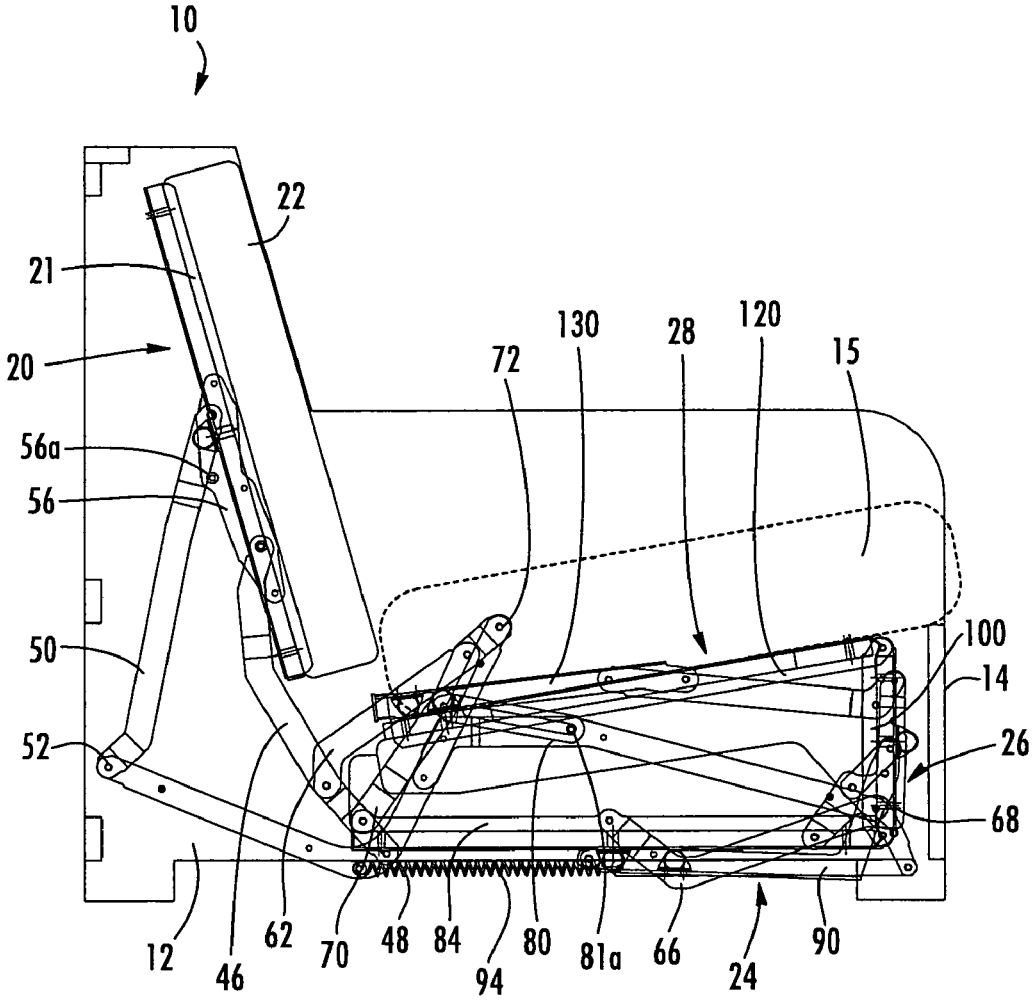
FIG. 1 is a side view of a sofa-bed according to embodiments of the present invention, with the sofa-bed shown in the folded position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Referring now to the figures, a sofa-bed, designated broadly at 10, is illustrated in FIG. 1. The sofa-bed 10 includes a frame 12, a seat 15, a backrest section 20, and a series of interconnected body, hinge and foot sections 24, 26, 28 with a common mattress cushion 30 that can be folded via a folding mechanism 40. The sofa-bed 10 is movable between (a) a folded position (shown in FIG. 1), in which the backrest section 20 is generally upright, the backrest, the seat 15 is generally horizontal and positioned forwardly of the backrest section 20, and the body, hinge and foot sections 24, 26, 28 are folded upon each other, with the body section 24 underlying the foot section 28 and the hinge section 26 extending between the body and foot sections 24, 28, and (b) an unfolded position (shown in FIGS. 3 and 4), in which the backrest section 20, the body section 24, the hinge section 26 and the foot section 28 are substantially horizontal and serially aligned with each other, with the backrest section 20 residing over the frame 12 and the mattress cushion 30 extending both over and in front of the frame 12.

The components identified above are described in greater detail below. For the sake of clarity, the sofa-bed 10 will be described initially in the unfolded position of FIGS. 3 and 4; movement to the folded position of FIG. 1 will then follow. As used herein to describe the relative positions of components, the terms "lateral", "outward" and derivatives thereof indicate the directions defined by a vector beginning at a vertical plane P (shown in FIG. 4) that bisects the sofa-bed 10 normal to the backrest section 20 and extending normal thereto. Conversely, the terms "inward", "inboard" and derivatives thereof indicate the direction opposite the "outward" direction. Together, the "inward" and "outward" directions comprise the "transverse" axis of the sofa-bed 10. The "rear" of the unfolded sofa-bed 10 is located at the end of the sofa-bed 10 nearest the backrest section 20, and the "front" of the sofa-bed 10 is located at the end nearest the foot section 28. The "front" and "rear" directions comprise the "longitudinal" axis of the sofa-bed 10. The "head" of the unfolded sofa-bed 10 is the end formed by the backrest section 20, and the "foot" of the unfolded sofa-bed 10 is the end formed by the foot section 28.

In addition, some components of the sofa-bed 10 (particularly the folding mechanism 40) are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 3:
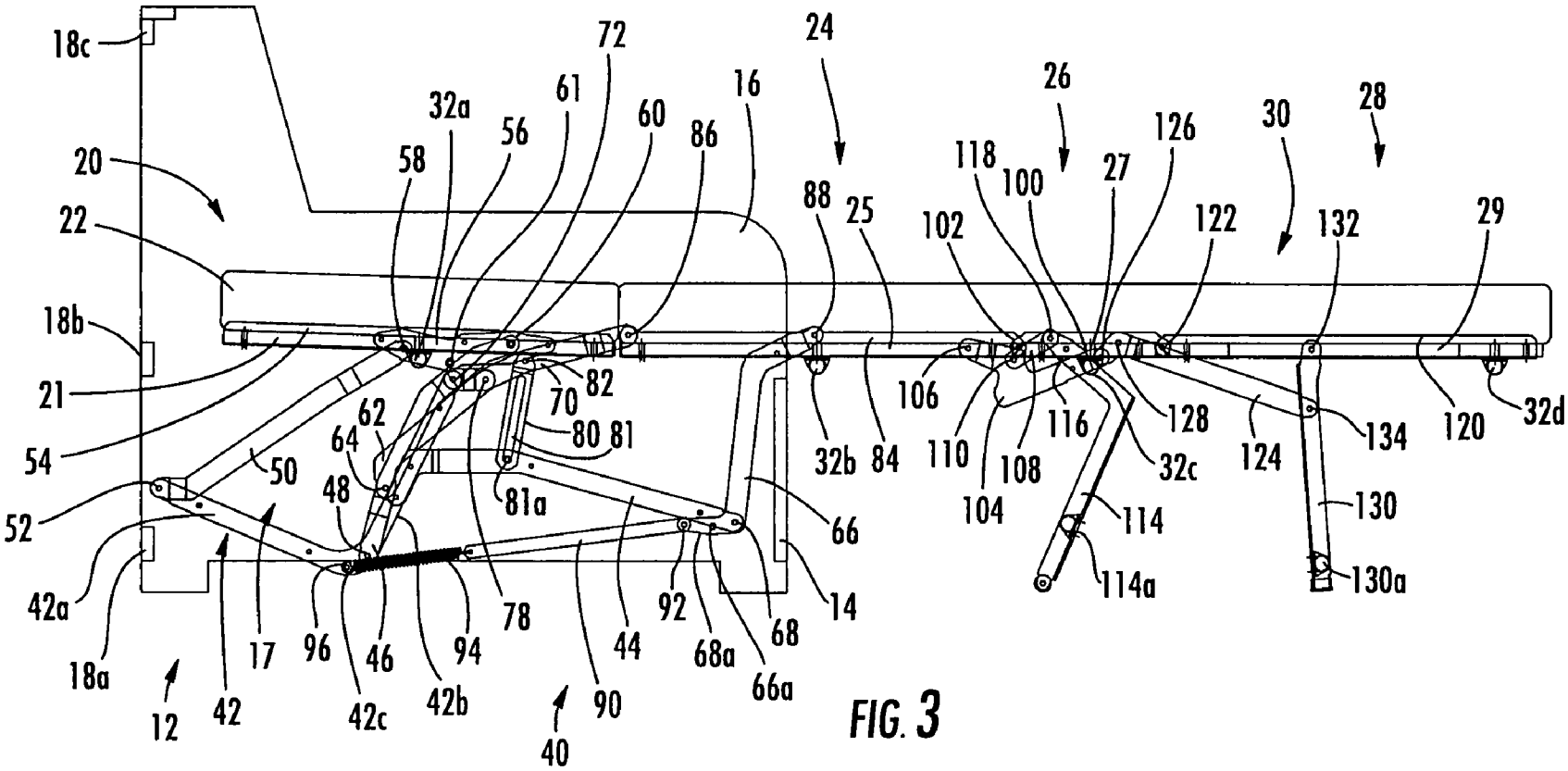
FIG. 3 is a side view of the sofa-bed of FIG. 1 shown in the unfolded position.
Figure 4:
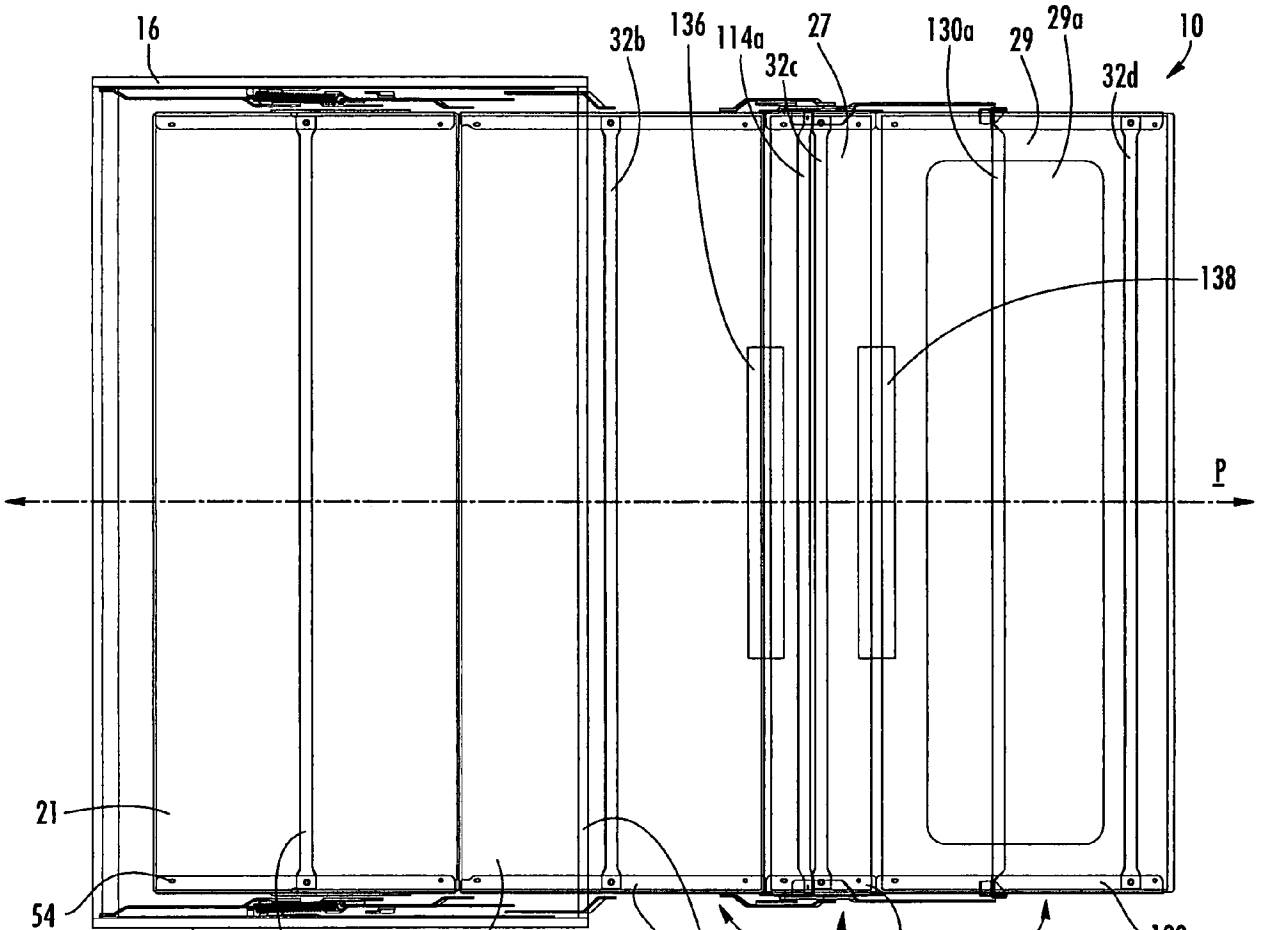
FIG. 4 is a top view of the sofa-bed of FIG. 1 shown in the unfolded position.

Turning now to FIGS. 3 and 4, the frame 12 includes a front panel 14 that extends transversely across the front of the frame 12. Arms 16 are fixed to each end of the front panel 14. Three rear cross-members 18*a*, 18*b*, 18*c* span the arms 16 and are mounted to rear portions thereof. The result is a cavity 17 formed by the frame 12 within which the body, hinge and foot sections 24, 26, 28 can reside when the sofa-bed 10 is in the folded position.

Referring again to FIGS. 3 and 4, the backrest section 20 includes a panel 21 that underlies a cushion 22. Backrest section support rails 54 support the lateral edges of the panel 21 from underneath, and a cross member 32*a* spans and is fixed at either end to the backrest section support rails 54. The body section 24 includes a panel 25, the hinge section 26 includes a panel. 27, and the foot section 28 includes a panel 29; these panels underlie the mattress cushion 30. The panels 25, 27, 29 are supported at their lateral edges by, respectively, body section support rails 84, hinge section support rails 100, and foot section support rails 120. Cross members 32*b*, 32*c*, 32*d* span, respectively, these rails below the panels 25, 27, 29 and are fixed at either end to the rails. The panel 29 includes a large open window 29*a* that is positioned to reside beneath a seated occupant of the sofa-bed 10 for additional comfort (see FIG. 4).

Referring now to FIG. 3, the folding mechanism 40 includes two separate mechanisms that are mirror images of one another about the plane P. The ensuing discussion will focus on only one mechanism 40, with the understanding that the discussion is equally applicable to the mechanism 40 on the opposite side of the sofa-bed 10.

The folding mechanism 40 includes an L-shaped rear mounting bracket 42 that is fixed to the inner surface of the arm 16 such that a rear leg 42*a* extends generally rearwardly from a vertex 42*c* and a front leg 42*b* extends generally upwardly and slightly forwardly. A front mounting bracket 44 is fixed to the arm 16 and to a central portion of the front leg 42*b* and extends generally forwardly and slightly downwardly therefrom. An angled front backrest swing link 46 is pivotally attached to the rear leg 42*a* at a pivot 48 near the vertex 42*c* and extends upwardly and slightly forwardly therefrom. A substantially straight rear backrest swing link 50 is pivotally attached at a pivot 52 to the rear end of the rear leg 42*a* and extends upwardly and forwardly therefrom. A mounting bracket 56 is fixed to the outside of the backrest section support rail 54. The rear backrest swing link 50 is pivotally interconnected to the mounting bracket 56 at a pivot 58 that is located near the center of the backrest section support rail 54, and the front backrest swing link 46 is pivotally attached to the mounting bracket 56 at a pivot 60 that is located near the front of the mounting bracket 56. A pin 61 extends laterally from the mounting bracket 56 and, in the unfolded position of FIGS. 3 and 4, rests on the rearward edge of the front backrest swing link 46.

Still referring to FIGS. 3 and 4, a rear body section extension link 62 is attached to the front backrest swing link 46 at a pivot 64 and extends forwardly and upwardly therefrom. A body section control link 70 is interconnected with the front leg 42*b* of the rear mounting bracket 42 at a pivot 72 and extends generally forwardly and slightly upwardly therefrom to terminate in a pivot 86 with the body section support rail 84. Also, the body section control link 70 is interconnected with the rear body section extension link 62 at a pivot 78 that is positioned just forward of the pivot 72. A slide link 80 is pivotally attached to the body section control link 70 at a pivot 82 that is located forwardly of the pivot 78. The slide link 80 extends downwardly and slightly rearwardly from the pivot 82. A slot 81 in the slide link receives a pin 81*a* that is located on the front leg 42*a* of the mounting bracket 42.

Referring still to FIGS. 3 and 4, a front body section extension link 66 is attached to the forward end of the front arm 44 at a pivot 68. A tail 68*a* of the front body section extension link 66 extends rearwardly from the pivot 68; a pin 66*a* extends laterally from the center of the tail 68*a* and strikes the underside of the front arm 42*a*. From the pivot 68, the front body section extension link 66 extends upwardly, then forwardly to a pivot 88 with the body section support rail 84. A drive link 90 is attached to the rear end of the tail 68*a* at a pivot 92 and extends generally rearwardly therefrom. A spring 94 extends from the rear end of the drive link 90 to a pin 96 located on the vertex 42*c* of the rear leg 42*a* of the mounting bracket 42. In the illustrated position, the spring 94 is in tension.

Referring once again to FIGS. 3 and 4, a tripartite drawing member 104 is attached to the body section support link 84 at a pivot 106. The drawing member 104 extends forwardly, then downwardly, then forwardly from the pivot 106. The body section support rail 84 is attached at its forward end to the rear end of the hinge section support rail 100 at a pivot 102. A control link 108 is attached to-the forward end of the rear leg of the drawing member 104 at a pivot 110 and extends forwardly and upwardly therefrom. A rear leg 114 is pivotally attached at its upper end to the forward end of the control link 108 at a pivot 118, and to the hinge section support rail 100 at a pivot 116. The rear leg 114 extends first forwardly, then rearwardly as it extends downwardly from the pivot 116 to the underlying surface. A cross-member 114*a* extends transversely between the lower ends of the rear legs 114 on opposite sides of the sofa-bed 10.

Referring still again to FIGS. 3 and 4, the forward end of the hinge section support rail 100 and the rear end of the foot section support rail 120 are connected at a pivot 122. An angled connecting link 124 is attached at one end to the forward end of the drawing member 104 at a pivot 126 and extends generally forwardly therefrom. At the vertex of the connecting link 124, a pivot 128 connects the connecting link 124 to the hinge section support rail 100. The front end of the connecting link 124 is attached at a pivot 134 to a front leg 130. The front leg 130 is attached at a pivot 132 to the foot section support rail 120 and extends generally downwardly therefrom through the pivot 134 to the underlying surface. A cross-member 130*a* extends transversely between the front legs 130 on opposite sides of the sofa-bed 10.

Figure 5:
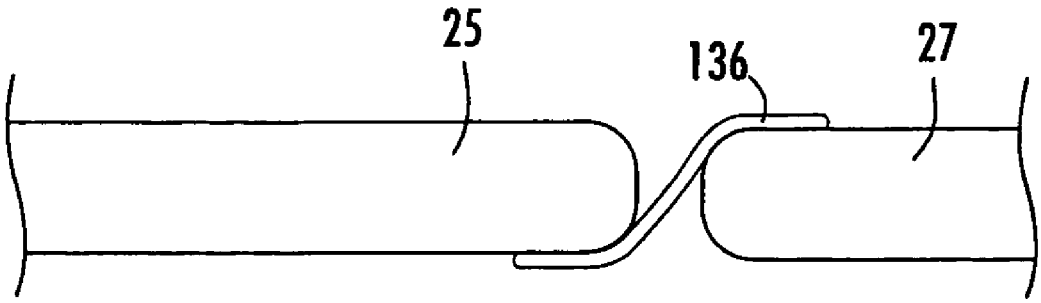
FIG. 5 is a greatly enlarged partial side view of the panels of the body and seat sections of the sofa-bed of FIG. 1 showing the position of the cloth support hinge in the unfolded position.
Figure 6:
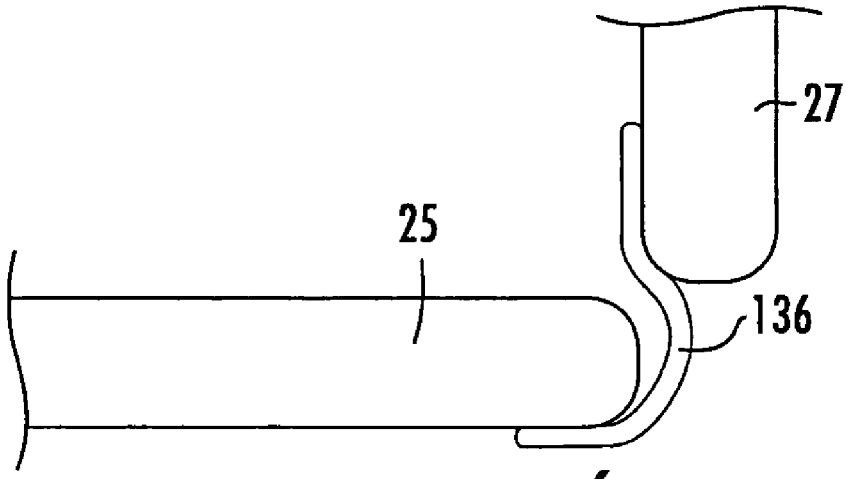
FIG. 6 is a greatly enlarged partial side view of the panels of the body and seat sections of FIG. 5 shown in the folded position.

Referring now to FIGS. 4, 5 and 6, the sofa bed 10 also includes two support hinges 136, 138 formed of cloth or another flexible sheet material. The support hinge 136 extends between the panels 25, 27 of the body and hinge sections 24, 26; more specifically, the hinge 136 is fixed to the lower surface of the panel 25 and to the upper surface of the panel 27. The support hinge 138 extends between the upper surface of the panel 27 and the lower surface of the panel 29. As can be seen in FIG. 5 (which illustrates the support hinge 136), when the sofa-bed 10 is in the unfolded position, the support hinge 136 is taut, and can provide support that resists a downwardly-directed force in the hinge area, thereby preventing bowing of the panels 25, 27 at that location. The support hinge 138 acts similarly: it is taut when the sofa-bed 10 is in the unfolded position and can assist the panels 27, 29 in resisting a downwardly-directed force at that location. In this embodiment, the support hinges 136, 138 are stapled to their respective panels, but could be attached via alternative fastening techniques. Also, although each support hinge 136, 138 is shown extending between the upper surface of one panel and the lower surface of the adjacent panel, similar results may be achieved for support hinges that extend between the upper surfaces of adjacent panels.

Figure 2:
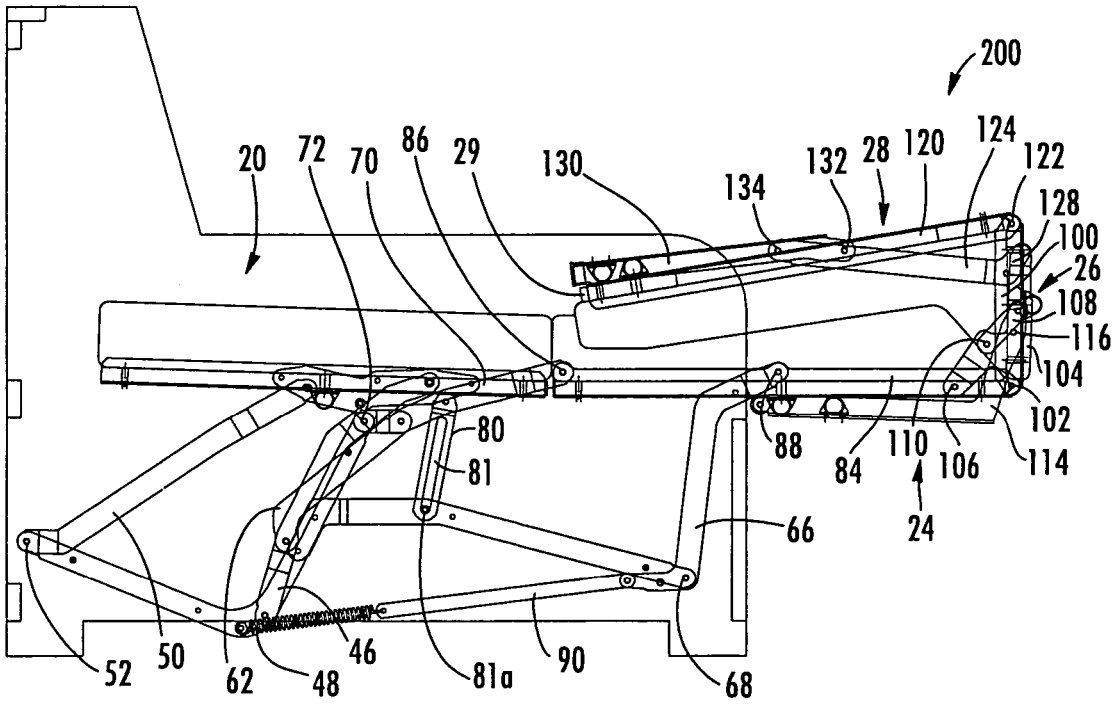
FIG. 2 is a side view of the sofa-bed of FIG. 1 shown in the intermediate position.

The sofa-bed 10 can be moved from the unfolded position of FIGS. 3 and 4 to the folded position of FIG. 1 via two separate movements: one which moves the sofa-bed 10 from the unfolded position of FIGS. 3 and 4 to an intermediate position (FIG. 2), in which the backrest and body sections 20, 24 are generally horizontally disposed and aligned, and the foot section 28 overlies the body section 24; and one which moves the sofa-bed from the intermediate position of FIG. 2 to the folded position of FIG. 1. These movements will be described in detail separately below.

To move the sofa-bed 10 from the unfolded position of FIGS. 3 and 4 to the intermediate position of FIG. 2, an upwardly-directed force is applied to the front end of the foot section 28. As the front end of the foot section 28 rises in response, the foot section 28 pivots about the pivot 122 (counterclockwise from the vantage point of FIG. 3) relative to the hinge section support rail 100. This action also raises the front leg 130 and moves its upper end nearer to the hinge section 26, which in turn causes (a) the connecting link 124 to rotate counterclockwise relative to the hinge section support rail 100 about the pivot 128 and (b) the front leg 130 to rotate counterclockwise relative to the foot section support rail 120 about the pivot 132. In addition, the hinge section support rail 100 pivots counterclockwise relative to the body section support rail 84 about the pivot 102. The combined movements of the connecting link 124 and the hinge section support rail 100 draw the drawing member 104 counterclockwise relative to the body section support rail 84 about the pivot 106. As the drawing member 104 rotates, it raises the rear end of the control link 108 and rotates it slightly clockwise about the pivot 110, which in turn raises the upper end of the rear leg 114. This movement rotates the rear leg 114 clockwise relative to the hinge section support rail 100 about the pivot 116, thereby drawing the lower end of the rear leg 114 upwardly and rearwardly.

The motion ceases when the front leg 130 rotates to a position in its lower end contacts the underside of the foot section panel 29. As can be seen in FIG. 2, in this position the foot section 28 is locked into place relative to the body and hinge sections 24, 26 via the "over-center" arrangement of the pivots 128, 132 and 134. In the illustrated embodiment, the foot section 28 actually rotates to a position past horizontal, such that the foot portion of the cushion 30 is compresses the body portion of the cushion 30.

Referring to FIG. 6, it can be seen that, as the hinge section 26 rotates relative to the body section 24, the support hinge 136 relaxes, such that there is slack in therein. Thus, the support hinge 136 can provide support to the sofa-bed 10 in the unfolded position, but does not interfere with the folding operation of the sofa-bed 10. The support hinge 138 behaves similarly; it supports the sofa-bed 10 from underneath in the unfolded position, but does not interfere with the folding operation.

To move the sofa-bed 10 from the intermediate position of FIG. 2 to the folded position of FIG. 1, an upwardly-directed force is applied to the folded assembly 200 comprising the body, hinge and foot sections 24, 26, 28. This force releases the body section 24 from a locked "over center" condition formed by pivots 72, 86 and 88 and enables the body section rail 84 to pivot counterclockwise relative about the pivot 88. This movement causes the body section control link 70 to rotate clockwise about the pivot 72, which draws the rear end of the folded assembly 200. Also, the slide link 80 drops, its movement being guided by the interaction of the pin 81*a* within the slot 81. As the body section control link 70 rotates, it drives the rear body section extension link 62 downwardly and rearwardly, which action forces the front backrest swing link 46 to rotate counterclockwise about the pivot 48. This movement draws the backrest section 20 rearwardly, and, guided by counterclockwise rotation of the rear backrest swing link 50, rotates the backrest section 20 clockwise, such that the rear end of the backrest section 20 rises.

Also, once the backrest section 20 has risen out of the way, the downward and rearward movement of the rear end of the folded assembly 200 is free to continue to travel toward the rear portion of the cavity of the frame 12. As the body section control link 70 continues to rotate clockwise, the front body section extension link 66 rotates counterclockwise about the pivot 68. The rotation of these links 70, 66 continues until front edge of the rear backrest section link 50 strikes a pin 56*a* on the mounting bracket 56, the pin 81*a* "bottoms out" in the slot 81, and the pin 61*a* contacts the bottom portion of the drawing member 104, at which time the folded assembly 200 is positioned inside the cavity of the frame 12 (FIG. 1). The movement of the folded assembly 200 from the intermediate position to the folded position is resisted by the spring 94, which resists the rotation of the front body section extension link 66 by urging the drive link 90 (and, in turn, the tail 68*a* of the front body section extension link 66) rearwardly. The resistance provided by the spring 94 assists in the folding operation; the folded assembly 200 can be quite heavy and difficult to manage (i.e., it would be easy to drop), so the resistance from the spring 94 can render the folded assembly 200 easier to handle.

The sofa-bed 10 can be moved from the folded position to the unfolded position by applying an upwardly directed force to the forward end of the folded assembly 200. The links of the mechanism 40 simply reverse the movements described above in returning to the intermediate and unfolded positions.

Those skilled in this art will recognize that the sofa-bed 10 may take other forms. For example, the frame 12 may have a different configuration. Also, the common cushion 30 may be formed of a single piece of foam or similar bedding material, multiple pieces of foam contained within a single cover, or multiple pieces of foam within separate covers. Moreover, other seating units, such as chairs, love seats, sectional pieces, and the like, may be employed with the present invention.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit, comprising:

a frame;

a backrest section having a backrest cushion;

body, hinge and foot sections sharing a common cushion; and a folding mechanism comprising a series of pivotally interconnected links configured and arranged to move the backrest, body, hinge and foot sections between folded and unfolded positions, wherein in the unfolded position, the backrest, body, hinge and foot sections are generally horizontally disposed and serially aligned, with the backrest cushion and the common cushion facing upwardly, and wherein in the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other;

wherein each of the body, hinge and foot sections includes a panel, and wherein a first support hinge comprising a flexible sheet member is fixed to the body and hinge section panels, and wherein a second support hinge comprising a flexible sheet member is fixed to the hinge and foot section panels.

2. A seating unit, comprising:

a frame;

a backrest section having a backrest cushion;

body, hinge and foot sections sharing a common cushion; and a folding mechanism comprising a series of pivotally interconnected links configured and arranged to move the backrest, body, hinge and foot sections between folded and unfolded positions, wherein in the unfolded position, the backrest, body, hinge and foot sections are generally horizontally disposed and serially aligned, with the backrest cushion and the common cushion facing upwardly, and wherein in the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other;

wherein each of the body and hinge sections comprise separate panels that underlie the common cushion, and wherein a flexible sheet member comprising a support hinge is connected between the panels of the body and hinge sections.

3. The seating unit defined in claim 2, wherein the support hinge extends between an upper surface of one of the body section and hinge section panels and a lower surface of the other of the body section and hinge section panels.

4. A seating unit, comprising:

a frame;

a backrest section having a backrest cushion;

body, hinge and foot sections sharing a common cushion; and a folding mechanism comprising a series of pivotally interconnected links configured and arranged to move the backrest, body, hinge and foot sections between folded and unfolded positions, wherein in the unfolded position, the backrest, body, hinge and foot sections are generally horizontally disposed and serially aligned, with the backrest cushion and the common cushion facing upwardly, and wherein in the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other;

wherein the reclining mechanism comprises:

a front backrest swing link that is pivotally interconnected with the backrest section and the frame;

a rear body section extension link that is pivotally interconnected with the front backrest swing link;

a body section control link that is pivotally interconnected with the rear body section extension link and with the body section; and a slide link that is pivotally interconnected with the body section control link and slidably and pivotally interconnected with the frame.

5. A seating unit, comprising:

a frame;

a backrest section having a backrest cushion;

body, hinge and foot sections sharing a common cushion, each of the body, hinge and foot sections including a panel underlying the common cushion; and a folding mechanism comprising a series of pivotally interconnected links configured and arranged to move the backrest, body, hinge and foot sections between folded and unfolded positions, wherein in the unfolded position, the backrest, body, hinge and foot sections are generally horizontally disposed and serially aligned, with the backrest cushion and the common cushion facing upwardly, and wherein in the folded position, the backrest section is generally upright with the backrest cushion facing forwardly, the body section is generally horizontally disposed, the foot section overlies the body section, and the hinge section is generally vertically disposed and extends between the body and foot sections, and the common cushion is folded upon itself, such that a portion of the common cushion overlying the body section and a portion of the common cushion underlying the foot section are compressed against each other;

wherein the foot section includes a panel that underlies the common cushion, and wherein the foot section panel includes a window that is positioned such that, when the seating unit is in the folded position, a seated occupant of the seating unit resides directly above the window.

6. The seating unit defined in claim 5, wherein the hinge section includes a panel that underlies the common cushion, and further comprising a support hinge formed of a flexible sheet member that is connected between the panels of the hinge section and the foot section.

* * * * *